US012280928B2

(12) United States Patent
Ubell et al.

(10) Patent No.: US 12,280,928 B2
(45) **Date of Patent: *Apr. 22, 2025**

(54) PRESSURE SENSITIVE FLEXIBLE BUTTON LOCK AND RETRACTABLE PACKAGE THEREOF

(71) Applicant: Sunshine Enclosures LLC, New York, NY (US)

(72) Inventors: Edward Ubell, New York, NY (US); Harry Kubetz, New York, NY (US)

(73) Assignee: Sunshine Enclosures LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/516,746

(22) Filed: Nov. 21, 2023

(65) Prior Publication Data

US 2024/0083642 A1 Mar. 14, 2024

Related U.S. Application Data

(63) Continuation of application No. 17/700,412, filed on Mar. 21, 2022, now Pat. No. 11,820,567.

(51) Int. Cl.
*B65D 5/38* (2006.01)
*B65D 55/02* (2006.01)

(52) U.S. Cl.
CPC ..... *B65D 55/02* (2013.01); *B65D 5/38* (2013.01)

(58) Field of Classification Search
CPC ..... B65D 5/38; B65D 5/321; B65D 2215/02; B65D 2215/04; B65D 2215/00; B65D 2401/10; B65D 11/12; B65D 23/0463; B65D 50/046; B65D 50/045; B65D 50/066; B65D 2583/0468; A61J 1/035; A61J 1/03; A61J 7/0069; E05B 73/0023
USPC ..... 220/345.3; 206/1.5, 531, 215, 468; 229/125.125
See application file for complete search history.

(56) References Cited

U.S. PATENT DOCUMENTS 3,933,240 A * 1/1976 Humble ..... E05B 73/0023 206/1.5

* cited by examiner

*Primary Examiner* — King M Chu
(74) *Attorney, Agent, or Firm* — Bochner PLLC; Andrew Bochner; Eric Kleinertz

(57) ABSTRACT

The invention of the present disclosure may be a pressure sensitive locking mechanism comprising a first tine, a second tine, and a third tine. The locking mechanism may further comprise a tab disposed on the second tine, where the tab may be orthogonal to the second tine. In an embodiment, the second tine is configurable in a locked state and an unlocked state, where the second tine comprises a second tine bell disposed on the lower portion of the second tine, and where the second tine bell is tapered from the tab to an upper portion of the second tine. The tab may be configured to receive a pressure, application of the pressure may be configured to convert the second tine from the locked state to the unlocked state, and withdrawal of the pressure may be configured to convert the second tine from the unlocked state to the locked state.

12 Claims, 5 Drawing Sheets

PRESSURE SENSITIVE FLEXIBLE BUTTON LOCK AND RETRACTABLE PACKAGE THEREOF

CROSS-REFERENCE TO RELATED APPLICATIONS

This application is a continuation of U.S. Non-Provisional application Ser. No. 17/700,412, filed Mar. 21, 2022. The entire contents of above-noted application are herein incorporated by reference in their entirety.

FIELD OF INVENTION

The present invention is in the field of reversibly lockable devices. Specifically, pressure-selective button locking mechanisms and the sliding packages thereof.

INTRODUCTION

People around the world have been storing their belongings in containers for centuries. Today, there are a number of containers available to people. These containers are made of various materials, in differing shapes and sizes. However, many such containers may be inadequate for various reasons. Specifically, many individuals may seek to store belongings that should not be readily available to minors. Thus, containers having easily removed lids or effortlessly opened drawers may be insufficient.

Many such containers may be equipped with an external lock, for example, a combination or key lock. Even further, other containers may not include mounting points for such locks. Such locks may be cumbersome and may decrease usable storage space. One may attempt to integrate traditional locking mechanisms into the internals of a container. However, traditional locking mechanisms may restrict storage space and may not be easily fitted to preexisting containers. For example, such containers may include dimensions or geometric features that are not conducive for retrofitted internal locking mechanisms.

Accordingly, it would be desirable to provide locking mechanisms that may be easily fitted within a wide range of containers. It would be further desirable to provide a container utilizing locking mechanisms that are unobtrusive, yet secure the container from entry by children.

SUMMARY

The invention of the present disclosure may be a pressure sensitive locking mechanism comprising a first tine, a second tine, and a third tine and a joining segment conjoined with the first tine, the second tine, and the third tine, wherein the first tine, the second tine, and the third tine are each orthogonal to the joining segment. The pressure sensitive locking mechanism may further comprise a tab disposed on a lower portion of the second tine, where the tab may be further disposed orthogonal to the second tine. In an embodiment, the second tine is configurable in a locked state and an unlocked state, where the second tine comprises a second tine bell disposed on the lower portion of the second tine, and where the second tine bell is tapered from the tab to an upper portion of the second tine. The tab and the second tine may be configured to receive a pressure via the tab, application of the pressure may be configured to convert the second tine from the locked state to the unlocked state, and withdrawal of the pressure may be configured to convert the second tine from the unlocked state to the locked state.

In an aspect, the tab may further comprise a first tab edge and a second tab edge, where the first tab edge and the second tab edge may each be orthogonal to the second tine; a tab rim comprising a convex curvature relative to the second tine; a first tab corner conjoining the tab rim and the first tab edge; and a second tab corner conjoining the tab rim and the second tab edge, where the first tab corner and the second tab corner are rounded.

In a further embodiment, the pressure sensitive locking mechanism further comprises a left first tine edge, a right first tine edge, a first tine base, a left second tine edge, a right second tine edge, a left third tine edge, a right third tine edge, a third tine base, a first root, and a second root, where the right first tine edge extends from the first root to the first tine base, where the left second tine edge extends from the first root to the tab, where the right second edge extends from the second root to the tab, where the left third tine edge extends from the second root to the third tine base, and where the right first tine edge and the left third tine edge are longer than the left second tine edge and the right second tine edge.

The invention of the present disclosure may be a pressure sensitive locking container comprising a pressure sensitive locking mechanism (for example, any embodiment of the pressure sensitive locking mechanism described herein) and a tray comprising a bottom surface, a first sidewall, a second sidewall, a front wall, a rear wall, and an aperture, where the tray is configurable in a sheathed state and an unsheathed state, and where the aperture is sized to accept the tab. The pressure sensitive locking container may further comprise a sleeve sized to accept the tray in the sheathed state, the sleeve comprising a sleeve window, where the sleeve window may be sized to accept the tab, where, in the sheathed state, the sleeve window may be overlaid the aperture, and where the tray may be configured to convert from the sheathed state to the unsheathed state via removal of the sleeve in the unlocked stated.

In an embodiment, the pressure sensitive locking mechanism is adhered to the first side wall such that, in the locked state, the tab extends through the aperture. The pressure sensitive locking container may further comprise a support extending from the pressure sensitive locking mechanism to the second sidewall.

The invention of the present disclosure may be a pressure sensitive locking container comprising two pressure sensitive locking mechanisms. In such an embodiment, the pressure sensitive locking container may further comprise a tray comprising a bottom surface, a first sidewall, a second sidewall, a front wall, a rear wall, a first aperture, and a second aperture, where the tray is configurable in a sheathed state and an unsheathed state, where the first aperture and the second aperture are sized to accept the tabs. The pressure sensitive locking container may further comprise a sleeve sized to accept the tray in the sheathed state, the sleeve may comprise a first sleeve window and a second sleeve window, where the first sleeve window and the second sleeve window are each sized to accept one of the tabs, where, in the sheathed state, the first sleeve window is overlaid the first aperture and the second sleeve window is overlaid the second aperture, and where the tray is configured to convert from the sheathed state to the unsheathed state via removal of the sleeve in the unlocked stated.

In an embodiment, the first pressure sensitive locking mechanism is adhered to the first side wall such that, in the locked state, the tab extends through the first aperture, and wherein the second pressure sensitive locking mechanism is adhered to the second side wall such that, in the locked state, the tab extends through the second aperture. In a further embodiment, the pressure sensitive locking container may further comprise a first support extending from the first pressure sensitive locking mechanism to the second sidewall, and a second support extending from the second pressure sensitive locking mechanism to the first sidewall.

Additional aspects related to this disclosure are set forth, in part, in the description which follows, and, in part, will be obvious from the description, or may be learned by practice of this disclosure.

It is to be understood that both the forgoing and the following descriptions are exemplary and explanatory only and are not intended to limit the claimed disclosure or application thereof in any manner whatsoever.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

Figure 1:
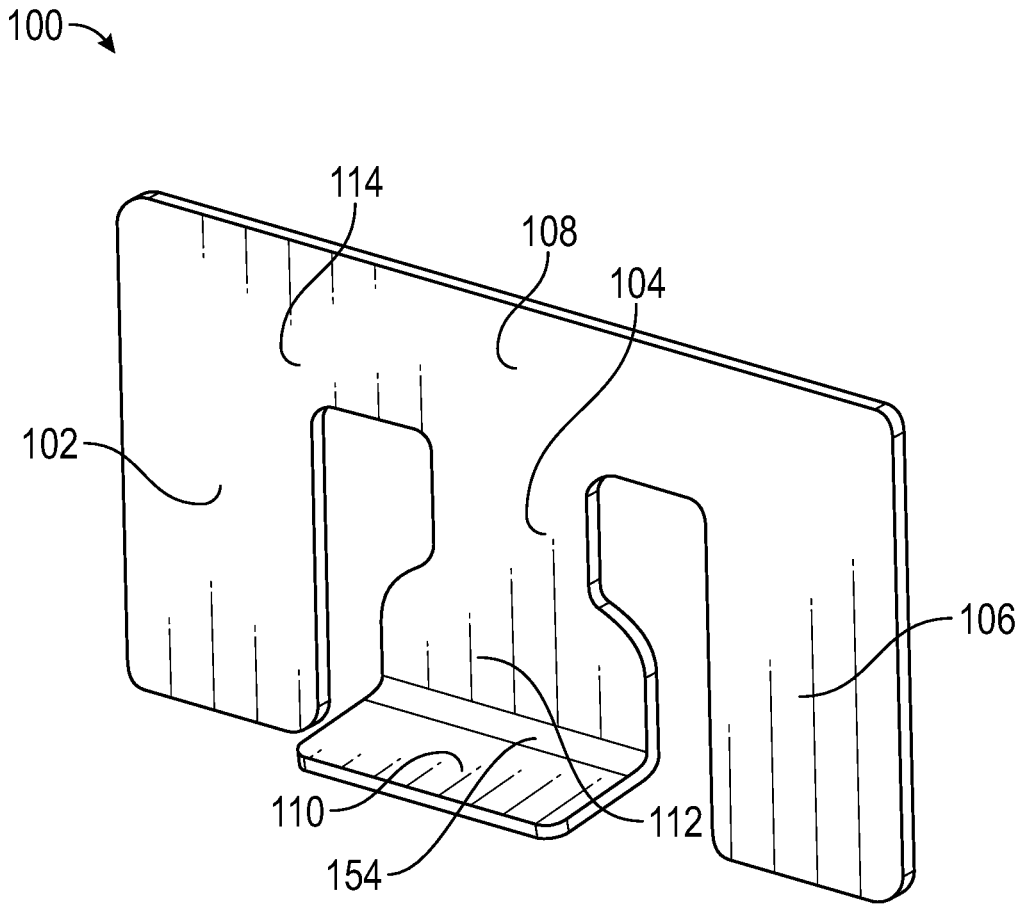
FIG. 1 is a front right perspective of an embodiment of a lock.

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

The invention of the present disclosure may be a lock 100, for example a pressure sensitive locking mechanism, comprising a first tine 102, a second tine 104, and a third tine 106. The lock 100 may further include a joining segment 108, wherein each of the first tine 102, the second tine 104, and the third tine 106 connect to the joining segment 108. In one embodiment, the first tine 102, the second tine 104, and the third tine 106 are disposed orthogonal to the joining segment 108. Any number and/or combination of the first tine 102, the second tine 104, and/or the third tine 106 may be disposed parallel to one another. However, the first tine 102, the second tine 104, and/or the third tine 106 may be disposed at any angle respective to one another or the joining segment 108. In one embodiment, the lock may have a width of 24.85 mm, a height of 17 mm, a thickness of 1 mm, with a tab having a width of 9.45 mm, a depth of 5.80 mm, and a thickness of 1.78 mm. However, the lock 100 and any components thereof may be any sufficient dimensions.

The second tine 104 may include a tab 110. In one embodiment, the tab 110 may be positioned on a lower portion 150 of the second tine 104, for example, on the second tine 104 end opposite of the joining segment 108. Thus, the second tine 104 may include a second tine upper portion 152 proximal to the joining segment 108. The tab 110 may extend from the second tine 104 at a ninety-degree angle, for example, perpendicular to the second tine 104. However, the tab 110 may extend from the second tine 104 at any suitable angle. As shown in FIG. 1, a ramp 154 may be disposed at the joining points of the second tine 104 and the tab 110. The ramp 154 may be curved as to dampen the ninety-degree angle that may exist between the second tine 104 and tab 110. Additionally, the ramp 154 may provide additional rigidity and strength to the tab 110 and/or the second tine 104, for example, by increasing the quantity of material disposed between the tab 110 and the second tine 104.

In an embodiment, the second tine 104 may include a second tine bell 112. The second tine bell 112 may be a bulbous portion of the second tine 104. For example, the second tine bell 112 may be a portion of the second tine bell 112, where the width of the second tine 104 increases towards the tab 110. Thus, the second tine bell 112 may be disposed between the upper portion 152 of the second tine 104 and the tab 110 or lower portion 150. The second tine bell 112 may be wider than the upper portion 152 of the second tine 104, for example, such that the second tine bell 112 is sized to accept the tab 110. Accordingly, the second tine bell 112 may increase the integrity of the second tine 104 and the tab 110, while enabling sufficient flexibility. In effect, the wider nature of the second tine bell 112 may promote rigidity in the lower portion 150, while the narrower nature of the upper portion 152 may promote flexibility. In such an embodiment, the decreased quantity of material in the upper portion 152 may enable the second tine 104 to flex more easily. In an embodiment, the upper portion 152 may be narrower to increase the flexibility of the second tine 104. However, the width of the upper portion 152 and the width of the second tine bell 112 may be configured in a ratio that enables a reasonable amount of pressure to unlock the lock 100. For example, if the upper portion 152 was too narrow relative to the second tine bell 112, the second tine 104 would unlock with too little applied pressure. Conversely, if the upper portion 152 was too wide relative to the second tine bell 112, the second tine 104 would unlock with a great difficulty, even to a capable adult. Moreover, the width of the second tine bell 112 and tab 110 (or tab rim 118) may be adapted to provide a comfortable surface to receive tactile pressure. In other words, the second tine bell 112 and tab 110 may be configured for comfort to the engaging user's finger. For the purposes of this disclosure, "reasonable pressure" may refer to a pressure above the capabilities of a child, but within the capabilities of an adult.

The lock 100 may include an inner surface 114 and an outer surface 116. The inner surface 114 may encompass the face of the lock 100 configured to interface with a box and/or the face of the lock 100 having the tab 110 protrusion. Accordingly, the outer surface 116 may be the face of the lock 100 opposite of the tab 110 protrusion. However, in various embodiments, the tab 110 protrusion may extend past the inner surface 114 and/or the outer surface 116.

The tab 110 may include a tab rim 118, a first tab edge 120, a second tab edge 122, a first tab corner 124, and/or a second tab corner 126. The tab rim 118 may be generally rounded such that the apex of the curvature occurs at the midpoint between the first tab corner 124 and the second tab corner 126. Thus, the tab rim 118 may be formed of a curvature, for example, a convex curvature relative to the second tine 104. In such an embodiment, the tab rim 118 may include a curve protruding away from the inner surface 114. However, the tab rim 118 may be flat. In various embodiments, the tab rim 118 may include any suitable curvature. The tab rim 118 may include curvature configured to enable actuation of the lock 100 by a user. Further, the first tab corner 124 and/or the second tab corner 126 may be rounded. Accordingly, the tab rim 118, the first tab corner 124, and/or the second tab corner 126 may be sized to accommodate smooth movement into a box (for example, an aperture and/or sleeve window) upon retraction of a box sleeve (described in further detail below). In short, the rounded and curved nature of the tab rim 118, the first tab corner 124, and the second tab corner 126 may prevent the tab 110 from becoming caught on the sleeve window 222 upon retraction of the sleeve. For example, if the tab 110 is particularly jagged or sharp, even upon actuation of the tab 110, the tab rim 118 may negatively interface with the sleeve window 222, causing the tab 110, sleeve 214, and/or tray 200 to bind.

The tab rim 118 may be adapted as an extension to assist the user in pressing and inducing the sleeve 214 to slide. The tab rim 118 may increase the reach of the user's finger when compressing. Further, the rounded nature of the tab 110 and components thereof, protect the aperture 202 and/or the sleeve window 222 from damage or tearing.

The tab 110 may further comprise a first tab edge 120 and a second tab edge 122. The first tab edge 120 may extend from the second tine bell 112 to the first tab corner 124. Similarly, the second tab edge 122 may extend from the second tine bell 112 to the second tab corner 126. Thus, the tab 110 may be bound by and/or formed by the first tab edge 120, the first tab corner 124, the tab rim 118, the second tab corner 126, the second tab edge 122, and the second tine bell 112 (for example, along the ramp 154).

The first tine 102 may include a left first tine edge 128, a right first tine edge 130, and/or a first tine base 132. The second tine 104 may include a left second tine edge 134 and/or a right second tine edge 136. The third tine 106 may include a left third tine edge 138, a right third tine edge 140, and/or a third tine base 142. A first root 144 may be disposed between the right first tine edge 130 and the left second tine edge 134. A second root 146 may be disposed between the right second tine edge 136 and the left third tine edge 138. Further, a joining segment edge 148 may extend atop the lock 100 between the left first tine edge 128 and the right third tine edge 140.

Figure 2:
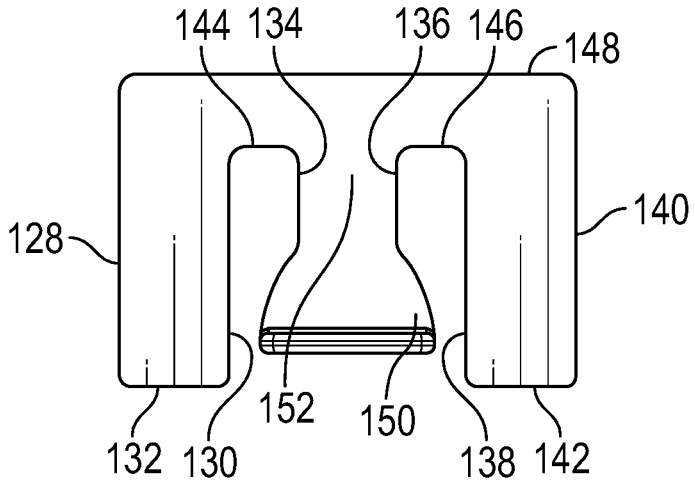
FIG. 2 is a front view of an embodiment of a lock.

In an embodiment, as shown in FIG. 2, the left first tine edge 128 and the right third tine edge 140 may have the same length. Further, the right first tine edge 130 and the left third tine edge 138 may have the same length. Further yet, the left second tine edge 134 and the right second tine edge 136 may have the same length. The left first tine edge 128 and the right third tine edge 140 may be longer than the right first tine edge 130; and the right first tine edge 130 and the left third tine edge 138 may be longer than the left second tine edge 134 and the right second tine edge 136. The joining segment edge 148 may be longer than any of the aforementioned edges 128-142. As shown in FIG. 2, the first tine base 132 and the third tine base 142 may have the same width. In such an embodiment, the tab 110 may have a width greater than that of the first tine base 132 and/or third tine base 142. In one embodiment, the first tine 102 and the third tine 106 may include a width greater than that of the second tine 104 or the upper portion 152, such that the first tine 102 and the third tine 106 may receive an adhesive and sufficiently adhere the lock 100 to a receiving surface. However, more generally, the width of the first tine 102 and the third tine 106 may be sized to maintain the position of the lock 100 along a receiving surface without the use of an adhesive.

Figure 3A:
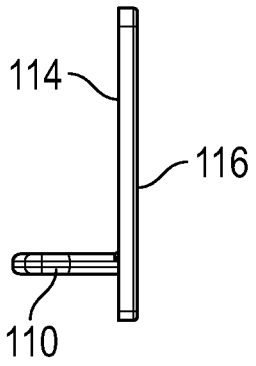
FIGS. 3A and 3B are side views of embodiments of a lock in a locked state and an unlocked state, respectively.
Figure 3B:
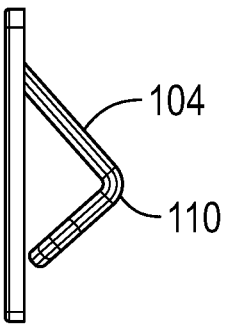
Figure 4:
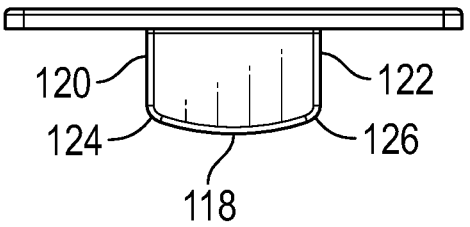
FIG. 4 is a top view of an embodiment of a lock.

Referring to FIGS. 3A-3B, the lock 100 and/or the second tine 104 may be configurable in a locked state and an unlocked state. In a locked state, as shown in FIG. 3A, the tab 110 may be orthogonal to the inner surface 114. In such a locked state, the tab 110 may be receiving minimal or no pressure from a user. In an unlocked state, as shown in FIG. 3B, the tab 110 may be disposed at least partially behind the outer surface 116. For example, the second tine 104 may include a pliability or flexibility, wherein a pressure may be applied to extend the tab 110 behind the outer surface 116. In such an example, the rigidity of the second tine 104 may be overcome via application of reasonable pressure to the tab 110. Further, the second tine 104 may include a plasticity, wherein the second tine 104 returns to the locked state after discontinuing pressure. In an unlocked state, the second tine 104 may gradually bend backward, wherein tension is more evenly distributed along the second tine 104. Alternatively, the upper portion 152 may be sized, such that in the unlocked position, the second tine 104 is generally straight and pivots about the section of the upper portion 152 immediately between the two roots 144/146.

While the tab 110 is outside the sleeve 214, the tab 110 may return to a "locked state," but in actuality the tray 200 is "unlocked." For example, when the sleeve 214 is disposed over the tray 200 completely, the lock 100 is in the locked position. In such an example, actuation of the lock 100 via pressure may cause the lock 100 to convert to the unlocked position. Further, retraction of the sleeve 214 may maintain the lock 100 in the unlocked position, as the sleeve 214 may maintain adequate pressure upon the lock 100 as the sleeve 214 is being removed. However, once the sleeve 214 has cleared the tab 110, the lock 100 may return to the locked state, yet the sleeve 214 and the tray 200 are separate. In such an instance, a user may reapply pressure to the tab 110 upon sheathing the sleeve 214 over the tray 200.

Figure 5:
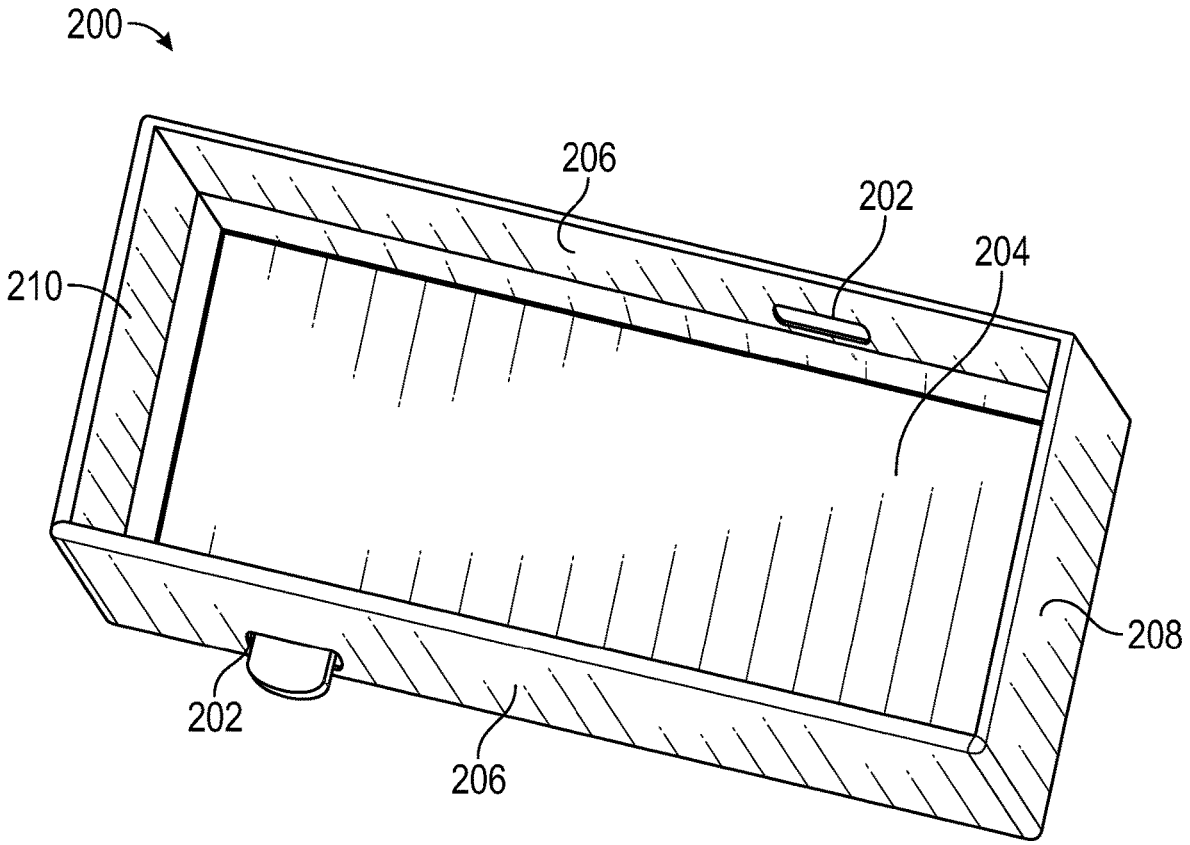
FIG. 5 is an illustration of an embodiment of a lock integrated into a tray container.

The invention of the present disclosure may include a tray 200. The tray 200 may comprise a bottom surface 204, one or more sidewalls 206 (for example, a first sidewall and a second sidewall), a front wall 208, and/or a rear wall 210. In an embodiment, one or more apertures 202 may be disposed on any of the one or more sidewalls 206, the front wall 208, and/or the rear wall 210. As a non-limiting example, as shown in FIG. 5, an aperture 202 may be disposed on both of the two sidewalls 206. However, in another embodiment, the tray 200 may include a single aperture 202. The aperture 202 may be rounded or otherwise oblong, such that the tab 110 is less likely to bind upon removal or reapplication of the sleeve 214. Furthermore, the aperture 202 may be sized slightly larger than the tab 110, such that the tab 110 and aperture 202 interface without causing undue wear or stress on either component.

In an embodiment, the inner surface 114 of the lock 100 may interface with one of the one or more sidewalls 206. The aperture 202 may be sized to accept the tab 110. Accordingly, a user may press the tab 110, causing the second tine 104 to flex into the tray 200. An adhesive may be applied to all portions of the lock 100 (for example, the inner surface 114), except for the second tine 104.

The tray 200 may include more than one apertures 202. For example, a first aperture may be disposed on a first sidewall and a second aperture may be disposed on a second sidewall. The aperture 202 may be disposed a distance from the bottom surface 204 such that the first tine base 132 and the third tine base 142 contact the bottom surface 204, and the tab 110 extends through the aperture 202 without contacting the bottom surface 204.

Figure 6:
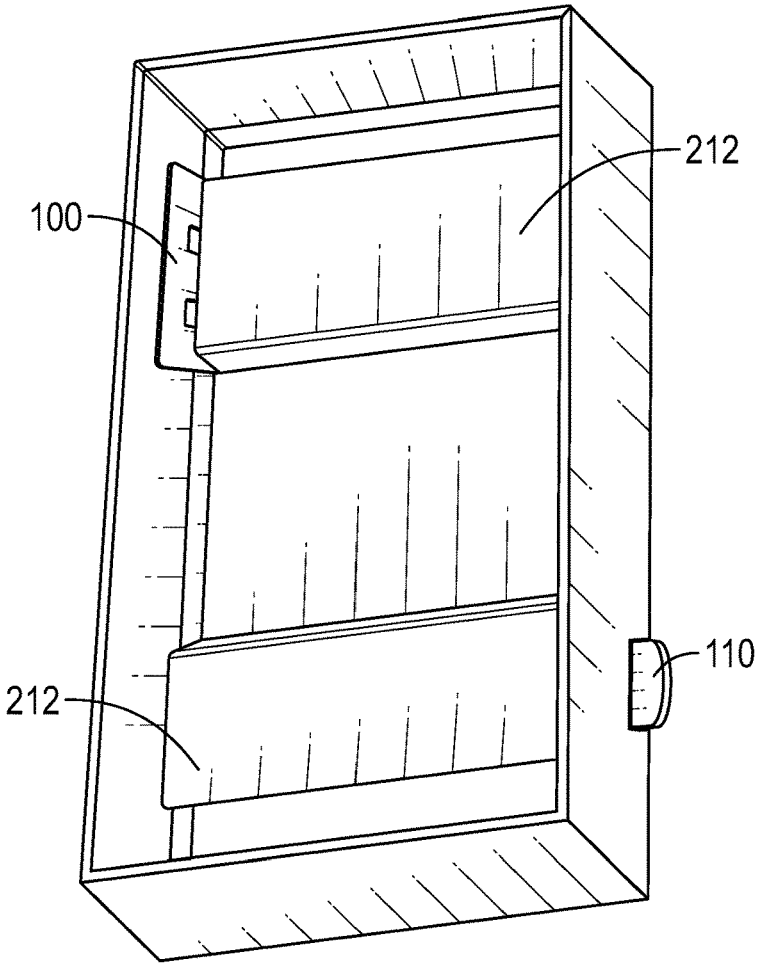
FIGS. 6-7 are illustrations of embodiments of tray containers comprising multiple locks and support members.
Figure 7:
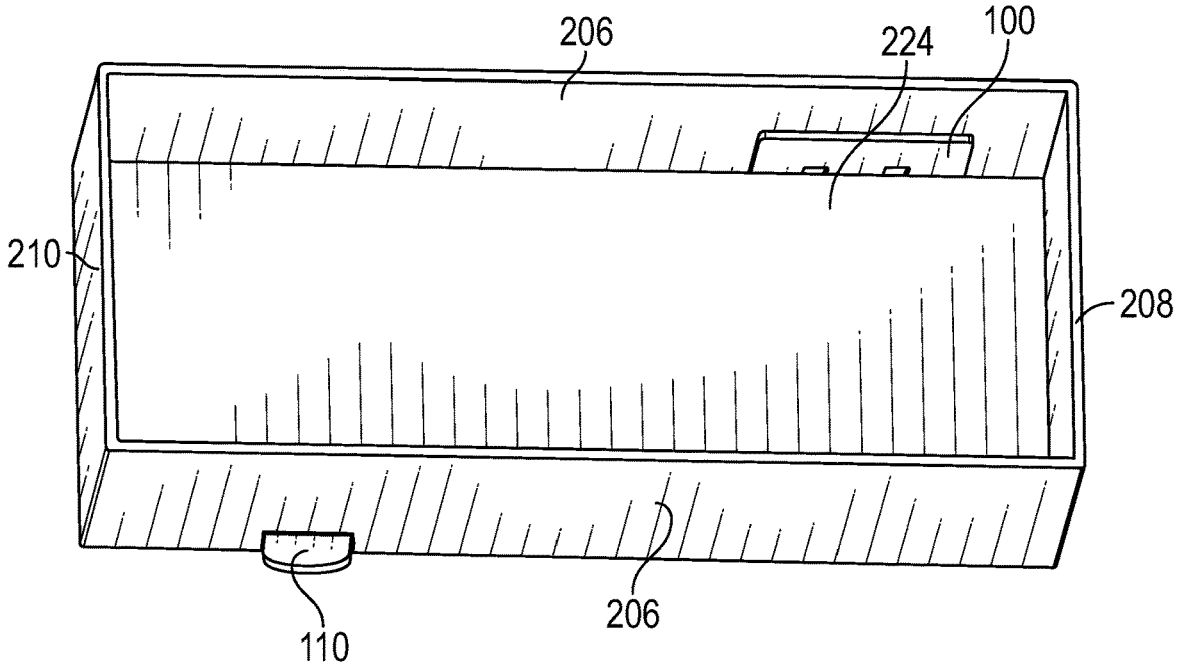

Referring to FIGS. 6-7, the tray 200 may include one or more supports 212. The supports 212 may be rectangular members that traverse the tray 200 between two of the one or more sidewalls 206. The supports 212 may be low-set rectangular members in contact with the bottom surface 204 and one or more sidewalls 206. In an embodiment, the support member 212 may be disposed orthogonal to the aperture 202. The support member 212 may be sized and configured to interface with the outer surface 116 of the lock 100. The support member 212 may be hollow or sufficiently semi-hollow, such that the second tine 104 may extend into the support member 212 without impassible resistance upon compression by the user. The support member 212 may be sized such that the lock 100 may be disposed between the support member 212 and the sidewall 206. For example, the support member 212 may be slightly shorter than the distance between the two sidewalls 206 to accommodate the depth of the lock 100. In an embodiment, a floor 224 is disposed atop the support members 212, such that the floor 224 is bound by the walls 206-210. Accordingly, the floor 224 may provide a stable and flat surface for the contents of the tray 200. Further, the floor 224 may serve to conceal (or at least partially conceal) the lock(s) 100 and/or the supports 212. For example, the floor 224 may prevent an unintended user for manipulating or disabling the lock(s) 100 or other tray 200 internals. Moreover, the floor 224 may rest along the outer surface(s) 116 of lock(s) 100, maintaining the position of the lock(s) along the sidewall(s) 206.

Figure 8A:
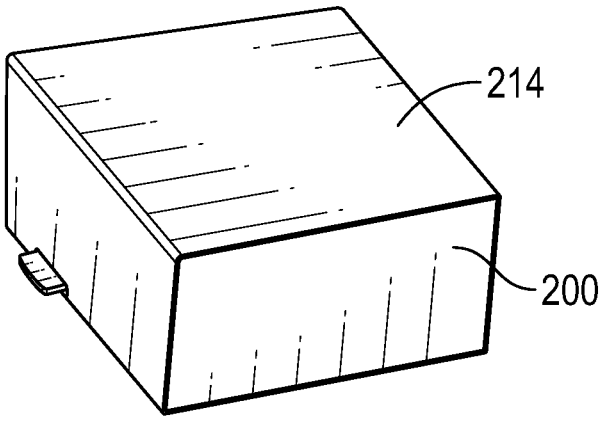
FIGS. 8A-8B are illustrations demonstrating embodiments of a lockable retractable container in a sheathed and unsheathed state, respectively.
Figure 8B:
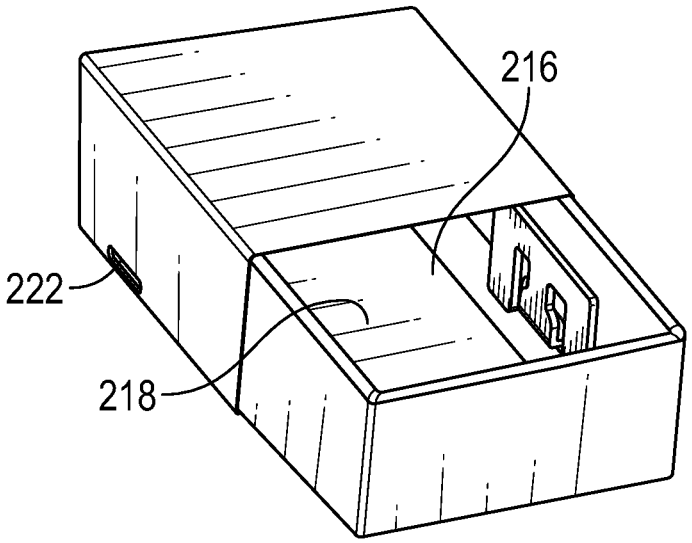

Referring to FIGS. 8A-8B, a sleeve 214 may be reversibly disposed over the tray 200. The sleeve 214 may be a rectangular member having a cavity 216 sized to accept the tray 200. The sleeve 214 may include a front sleeve opening 218 and/or a rear sleeve opening 220. Further, the sleeve 214 may include one or more sleeve windows 222, where the sleeve windows 222 may be positioned over the aperture 202 when the sleeve is in a sheathed position. In a sheathed position, the sleeve 214 may surround the tray 200. In an unsheathed position, the sleeve 214 may be removed from the tray 200. Accordingly, in a sheathed position, one or more tabs 110 may extend through the one or more apertures 202 and sleeve windows 222.

In an embodiment, the tray 200 may be converted from a sheathed position to an unsheathed position by compressing the one or more tabs 110 and withdrawing the sleeve 214 from the tray 200. In such an embodiment, a user may compress the tab 110 a distance where the tab rim 118 clears the sleeve window 222. In effect, the tab 110 extending through the sleeve window 222 may act to lock the sleeve to the tray 200. Thus, by removing the tab 110 obstruction from the sleeve window 222 the tray 200 and sleeve 214 may be 'unlocked.'

The tray 200 may include two apertures 202 and two locks 100; and the sleeve 214 may include two sleeve windows 222. In such an embodiment, each of the two locks 100 may be disposed on opposite side walls. Further, each of the two locks 100 may be disposed on opposite ends of the tray 200 (for example, a first lock 100 may be disposed on a sidewall portion proximally to the rear wall 210 and a second lock 100 may be disposed on a sidewall portion proximally to the front wall 208, as shown in FIGS. 6-7). As a non-limiting example, a tray 200 having two locks 100 may require a user to utilize two hands or two fingers to depress both tabs 110 and remove the sleeve 214. In such an example, the tray 200 and sleeve 214 may be "child proof," "child resistant," or "tamper proof." However, such an embodiment may enable compression of both tabs 110 by compression with one hand, for example, by grasping the underside of the tray 200 and compressing a first tab with one's thumb and a second tab with one's ring finger.

In an embodiment, the sleeve 214 can be removed from the tray 200 in two directions. However, in a further embodiment, wherein the sleeve 214 comprises five sides, the sleeve 214 may only be removed from the tray 200 in one direction. In an embodiment where the sleeve 214 comprises four sides, the sleeve 214 may be coupled with the tray 200 from a first orientation and a second orientation, wherein the second orientation is rotated 180 degrees relative to the first orientation.

The tray 200 may include two locks 100, wherein the first lock is disposed on a sidewall 206 opposite the second lock. The first lock (and corresponding aperture 202) may be disposed at a position between the front wall 208 and the midpoint between the front wall 208 and the rear wall 210. The second lock (and corresponding aperture 202) may be disposed at a position between the rear wall 210 and the midpoint between the front wall 208 and the rear wall 210. Accordingly, by staggering the positions of the first lock and the second lock, the tray 200 and sleeve 214 may be more securely locked. For example, a child may exhibit great difficulty in actuating the first lock and the second lock, when said locks are disposed in this staggered position.

In an embodiment, the lock 100 may be composed of a plastic. For example, the plastic may have a flexibility, rigidity, and plasticity sufficient to enable conversion between a locked and unlocked state. However, the lock 100 may be composed of any suitable material.

The material of the lock 100, tray 200, and/or sleeve 214 may be environmentally friendly. For example, the use of plastics may be minimized. However, in one embodiment, the lock 100 may be composed of plastic. The lock 100 may also be made from Polylactic Acid (PLA) or other suitable materials manufactured from corn. The sleeve 214 may include a polypropylene layer. Accordingly, the polypropylene layer may increase the sleeve 214 rigidity and integrity. For example, the polypropylene layer may prevent a child from ripping, tearing, or chewing through the sleeve 214. The polypropylene layer, or other suitable layer, may make the sleeve 214 water resistant, such that a child may not weaken the integrity of the sleeve 214 with liquid. In a further embodiment, the tray 200 may include a polypropylene layer. The sleeve 214, the tray 200, and/or the lock 100 may be manufactured such that they are compostable.

Finally, other implementations of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A pressure sensitive locking mechanism comprising:

at least one tine;

a joining segment conjoined with the at least one tine;

a tab disposed on a lower portion of the at least one tine, the tab having a first tab edge and a second tab edge, a tab rim comprising a convex curvature relative to the at least one tine, a first tab corner conjoining the tab rim and the first tab edge, and a second tab corner conjoining the tab rim and the second tab edge, wherein the first tab corner and the second tab corner are rounded; and the at least one tine configurable in a locked state and an unlocked state, the at least one tine comprising an at least one tine bell disposed on the lower portion of the at least one tine, wherein the tab and the at least one tine are configured to receive a pressure via the tab, wherein application of the pressure is configured to convert the at least one tine from the locked state to the unlocked state, and wherein withdrawal of the pressure is configured to convert the at least one tine from the unlocked state to the locked state.

2. The pressure sensitive locking mechanism of claim 1, further comprising a left first tine edge, a right first tine edge, a first tine base, a left second tine edge, a right second tine edge, a left third tine edge, a right third tine edge, a third tine base, a first root, and a second root, wherein the right first tine edge extends from the first root to the first tine base, wherein the left second tine edge extends from the first root to the tab, wherein the right second tine edge extends from the second root to the tab, wherein the left third tine edge extends from the second root to the third tine base, and wherein the right first tine edge and the left third tine edge are longer than the left second tine edge and the right second tine edge.

3. A pressure sensitive locking container comprising:

a pressure sensitive locking mechanism comprising:

a first tine, a second tine, and a third tine;

a joining segment conjoined with the first tine, the second tine, and the third tine;

a tab disposed on a lower portion of the second tine; and the second tine configurable in a locked state and an unlocked state, the second tine comprising a second tine bell disposed on the lower portion of the second tine, wherein the tab and the second tine are configured to receive a pressure via the tab, wherein application of the pressure is configured to convert the second tine from the locked state to the unlocked state, and wherein withdrawal of the pressure is configured to convert the second tine from the unlocked state to the locked state;

a tray, wherein the tray is configurable in a sheathed state and an unsheathed state, wherein a tray aperture is sized to accept the tab; and a sleeve sized to accept the tray in the sheathed state, the sleeve comprising a sleeve window, wherein the sleeve window is sized to accept the tab, wherein, in the sheathed state, the sleeve window is overlaid the tray aperture, and wherein the tray is configured to convert from the sheathed state to the unsheathed state via removal of the sleeve in the unlocked stated.

4. The pressure sensitive locking container of claim 3, the tab further comprising:

a first tab edge and a second tab edge, the first tab edge and the second tab edge orthogonal to the second tine;

a tab rim comprising a convex curvature relative to the second tine;

a first tab corner conjoining the tab rim and the first tab edge; and a second tab corner conjoining the tab rim and the second tab edge, wherein the first tab corner and the second tab corner are rounded.

5. The pressure sensitive locking container of claim 3, further comprising a left first tine edge, a right first tine edge, a first tine base, a left second tine edge, a right second tine edge, a left third tine edge, a right third tine edge, a third tine base, a first root, and a second root, wherein the right first tine edge extends from the first root to the first tine base, wherein the left second tine edge extends from the first root to the tab, wherein the right second tine edge extends from the second root to the tab, wherein the left third tine edge extends from the second root to the third tine base, and wherein the right first tine edge and the left third tine edge are longer than the left second tine edge and the right second tine edge.

6. The pressure sensitive locking container of claim 3, wherein the pressure sensitive locking mechanism is adhered to a first sidewall such that, in the locked state, the tab extends through the aperture.

7. The pressure sensitive locking container of claim 6, further comprising a support extending from the pressure sensitive locking mechanism to a second sidewall.

8. A pressure sensitive locking container comprising:

two pressure sensitive locking mechanisms, each comprising:

a first tine, a second tine, and a third tine;

a joining segment conjoined with the first tine, the second tine, and the third tine;

at least one tab disposed on a lower portion of the second tine; and the second tine configurable in a locked state and an unlocked state, the second tine comprising a second tine bell disposed on the lower portion of the second tine, wherein the at least one tab and the second tine are configured to receive a pressure via the tab, wherein application of the pressure is configured to convert the second tine from the locked state to the unlocked state, and wherein withdrawal of the pressure is configured to convert the second tine from the unlocked state to the locked state;

a tray comprising a first aperture, and a second aperture, wherein the tray is configurable in a sheathed state and an unsheathed state, wherein the first aperture and the second aperture are sized to accept the at least one tab; and a sleeve sized to accept the tray in the sheathed state, the sleeve comprising a first sleeve window and a second sleeve window, wherein the first sleeve window and the second sleeve window are each sized to accept the at least one tab, wherein, in the sheathed state, the first sleeve window is overlaid the first aperture and the second sleeve window is overlaid the second aperture, and wherein the tray is configured to convert from the sheathed state to the unsheathed state via removal of the sleeve in the unlocked stated.

9. The pressure sensitive locking container of claim 8, each tab further comprising:

a first tab edge and a second tab edge, the first tab edge and the second tab edge orthogonal to the second tine;

a tab rim comprising a convex curvature relative to the second tine;

a first tab corner conjoining the tab rim and the first tab edge; and a second tab corner conjoining the tab rim and the second tab edge, wherein the first tab corner and the second tab corner are rounded.

10. The pressure sensitive locking container of claim 8, each pressure sensitive locking mechanism further comprising a left first tine edge, a right first tine edge, a first tine base, a left second tine edge, a right second tine edge, a left third tine edge, a right third tine edge, a third tine base, a first root, and a second root, wherein the right first tine edge extends from the first root to the first tine base, wherein the left second tine edge extends from the first root to the tab, wherein the right second tine edge extends from the second root to the tab, wherein the left third tine edge extends from the second root to the third tine base, and wherein the right first tine edge and the left third tine edge are longer than the left second tine edge and the right second tine edge.

11. The pressure sensitive locking container of claim 8, wherein the first pressure sensitive locking mechanism is adhered to a first sidewall such that, in the locked state, the tab extends through the first aperture, and wherein the second pressure sensitive locking mechanism is adhered to the second sidewall such that, in the locked state, the tab extends through the second aperture.

12. The pressure sensitive locking container of claim 11, further comprising a first support extending from the first pressure sensitive locking mechanism to the second sidewall:

and a second support extending from the second pressure sensitive locking mechanism to the first sidewall.

* * * * *